US010365591B2

(12) United States Patent
Yamada

(10) Patent No.: US 10,365,591 B2
(45) Date of Patent: Jul. 30, 2019

(54) FIXING DEVICE AND IMAGE FORMING APPARATUS

(71) Applicant: KYOCERA Document Solutions Inc., Osaka (JP)

(72) Inventor: Masayuki Yamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/120,477

(22) Filed: Sep. 4, 2018

(65) Prior Publication Data

US 2019/0121264 A1 Apr. 25, 2019

(30) Foreign Application Priority Data

Oct. 24, 2017 (JP) ..... 2017-205347

(51) Int. Cl.
*G03G 15/20* (2006.01)
*G03G 21/16* (2006.01)

(52) U.S. Cl.
CPC ..... *G03G 15/2025* (2013.01); *G03G 21/169* (2013.01); *G03G 21/1628* (2013.01); *G03G 21/1685* (2013.01)

(58) Field of Classification Search
CPC ..... G03G 15/2025; G03G 21/169; G03G 21/1628; G03G 21/1685
See application file for complete search history.

(56) References Cited

U.S. PATENT DOCUMENTS 5,592,275 A * 1/1997 Echigo ..... G03G 15/2025 118/60
5,826,141 A * 10/1998 Mitsuya ..... G03G 15/2064 399/122
2003/0049047 A1* 3/2003 Suzuki ..... G03G 21/1638 399/124
2006/0285891 A1* 12/2006 Fujisawa ..... G03G 15/2064 399/329
2011/0236083 A1* 9/2011 Shimizu ..... G03G 15/2025 399/327
2015/0268609 A1* 9/2015 Yamada ..... B65H 3/00 399/328

FOREIGN PATENT DOCUMENTS

JP 60067963 A * 4/1985 ..... G03G 21/1628
JP 2009-069398 A 4/2009

* cited by examiner

*Primary Examiner* — Ryan D Walsh
(74) *Attorney, Agent, or Firm* — Studebaker & Brackett PC

(57) ABSTRACT

A fixing device includes a fixing member, a pressing member, a cover and a cleaning device. The fixing member is configured to heat a toner on a medium while rotating. The pressing member is configured to form a pressing area with the fixing member while rotating and to press the toner on the medium passing through the pressing area. The cover is configured to be moved in one direction in an opening and closing direction to form a part of a conveying path for the medium and to be moved in the other direction in the opening and closing direction to open the part of the conveying path. The cleaning device is provided in the cover and configured to bring a cleaning member into contact with a surface of the fixing member in a state where the cover is moved in the one direction and to clean the surface.

10 Claims, 8 Drawing Sheets

FIXING DEVICE AND IMAGE FORMING APPARATUS

INCORPORATION BY REFERENCE

This application is based on and claims the benefit of priority from Japanese Patent application No. 2017-205347 filed on Oct. 24, 2017, which is incorporated by reference in its entirety.

BACKGROUND

The present disclosure relates to a fixing device and an image forming apparatus.

An electrophotographic type image forming apparatus is provided with a fixing device configured to fix a toner image on a medium, such as a sheet.

The fixing device is sometimes provided with a cleaning device which brings a cleaning member into contact with a fixing roll almost at the same time when the sheet is passed through a nip area and cleans the fixing roll. The cleaning member is supported by a tuning member, and is configured such that the sheet passed through the nip area presses the turning member to bring the cleaning member into contact with the fixing roll.

However, in the above described fixing device, no consideration has been given for a maintenance work to clean and replace the contaminated cleaning member. Thereby, the maintenance work cannot be performed without disassembling the fixing device. That is, the above described fixing device has a problem in which the maintenance work and the management of the cleaning member cannot be easily performed.

SUMMARY

In accordance with an aspect of the present disclosure, a fixing device includes a fixing member, a pressing member, a cover and a cleaning device. The fixing member is configured to heat a toner on a medium while rotating. The pressing member is configured to form a pressing area with the fixing member while rotating and to press the toner on the medium passing through the pressing area. The cover is configured to be moved in one direction in an opening and closing direction to form a part of a conveying path for the medium and to be moved in the other direction in the opening and closing direction to open the part of the conveying path. The cleaning device is provided in the cover and configured to bring a cleaning member into contact with a surface of one of the fixing member and the pressing member in a state where the cover is moved in the one direction and to clean the surface of one of the fixing member and the pressing member.

In accordance with an aspect of the present disclosure, an image forming apparatus includes the fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
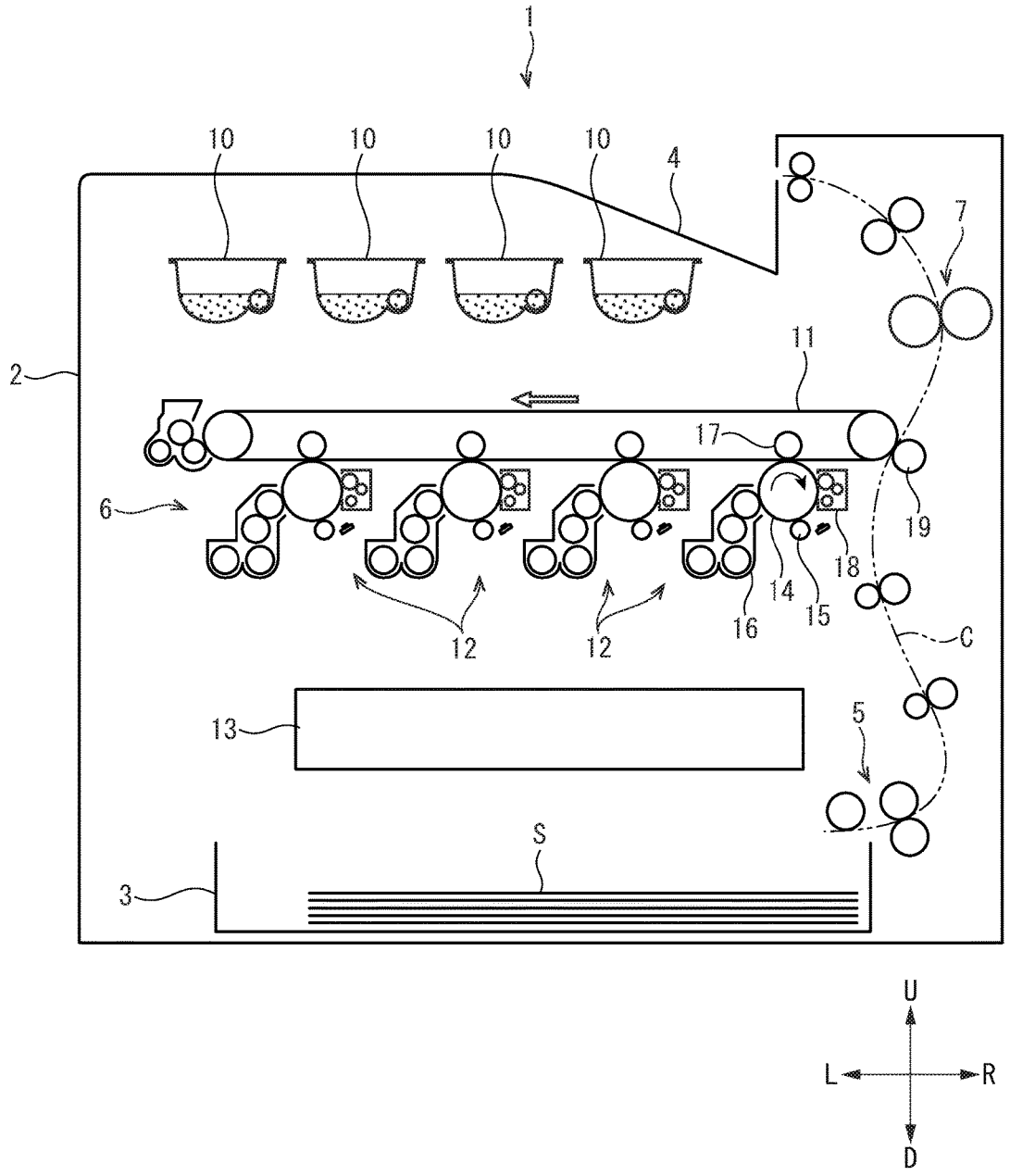
FIG. 1 is a front view schematically showing an inner structure of a color printer according to a first embodiment of the present disclosure.

Hereinafter, with reference to the attached drawings, an embodiment of the present disclosure will be described. In FIG. 1 and the others, a near side of a paper surface is defined to be a front side, and "Fr", "Rr", "L", "R", "U" and "D" in each figure respectively indicates "a front side", "a rear side", "a left side", "a right side", "an upper side" and "a lower side".

[A first embodiment: an outline of a color printer] With reference to FIG. 1, an entire structure of a color printer 1 as an example of the image forming apparatus will be described. FIG. 1 is a front view schematically showing an inner structure of the color printer 1.

The color printer 1 includes an apparatus main body 2 constituting an approximately rectangular parallelepiped shaped appearance. In a lower portion of the apparatus main body 2, a sheet feeding cassette 3 storing a paper sheet S (a medium) is detachably provided. On an upper face of the apparatus main body 2, an ejected sheet tray 4 is provided. The sheet 3 is not limited to the paper sheet and may be a resin sheet or the like.

The color printer 1 includes a sheet feeding device 5, an image forming device 6 and a fixing device 7 which are provided inside the apparatus main body 2. The sheet feeding device 5 is provided at an upstream end portion of a conveying path C extending from the sheet feeding cassette 3 to the ejected sheet tray 4. The fixing device 7 is provided at a downstream portion of the conveying path C. The image forming device 6 is provided between the sheet feeding device 5 and the fixing device 7 on the conveying path C.

The image forming device 6 includes four toner containers 10, an intermediate transferring belt 11, four drum units 12 and an optical scanning device 13. The intermediate transferring belt 11 is rotated in a direction shown by an arrow in FIG. 1. The four toner containers 10 respectively store yellow toner, magenta toner, cyan toner and black toner. Each drum unit 12 includes a photosensitive drum 14, a charge device 15, a development device 16, a primary transferring roller 17 and a cleaning device 18. Between each primary transferring roller 17 and the photosensitive drum 14, the intermediate transferring belt 11 is put. A right side portion of the intermediate transferring belt 11 comes into contact with a secondary transferring roller 19 to form a transferring nip.

The color printer 1 performs the following image forming processing. Each charge device 15 charges a surface of the photosensitive drum 14. Each photosensitive drum 14 is exposed with a scanning light emitted from the optical scanning device 13 to carry an electrostatic latent image. Each development device 16 develops the electrostatic latent image on the photosensitive drum 14 using the toner supplied from the toner container 10 to a toner image. Each primary transferring roller 17 primarily transfers the toner image on the photosensitive drum 14 to the rotating intermediate transferring belt 11. The intermediate transferring belt 11 carries a full color toner image, which is formed by overlapping the four colored toner images, while rotating. The sheet S is fed to the conveying path C by the sheet feeding device 5 from the sheet feeding cassette 3. The secondary transferring roller 19 secondarily transfers the full color toner image on the intermediate transferring belt 11 to the sheet S passing through the transferring nip. The fixing device 7 heats the toner image and fixes it on the sheet S. Then, the sheet S is ejected on the ejected sheet tray 4. Each cleaning device 18 removes the toner remained on the photosensitive drum 14.

Figure 2:
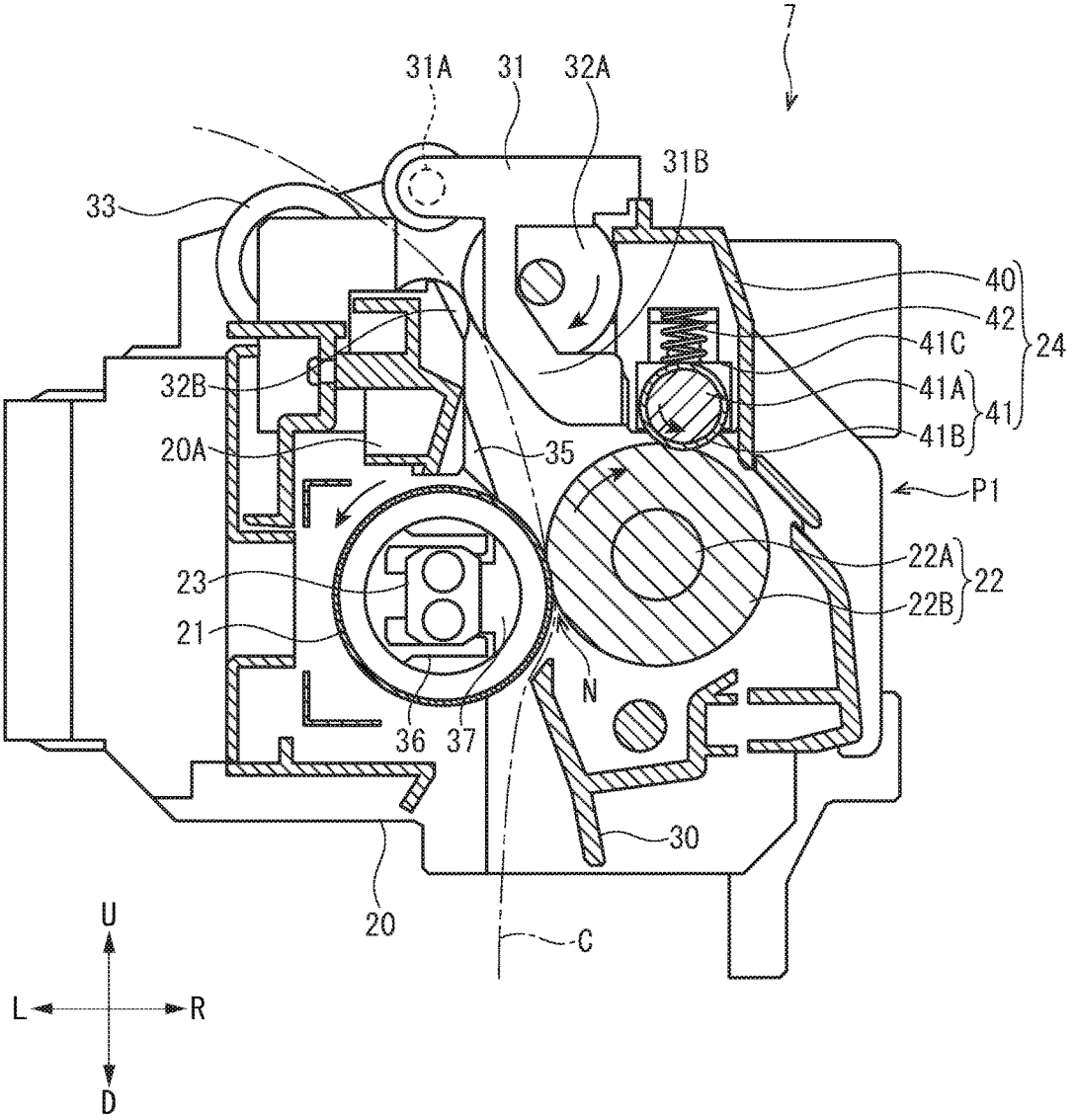
FIG. 2 is a sectional view showing a fixing device according to the first embodiment of the present disclosure.
Figure 3:
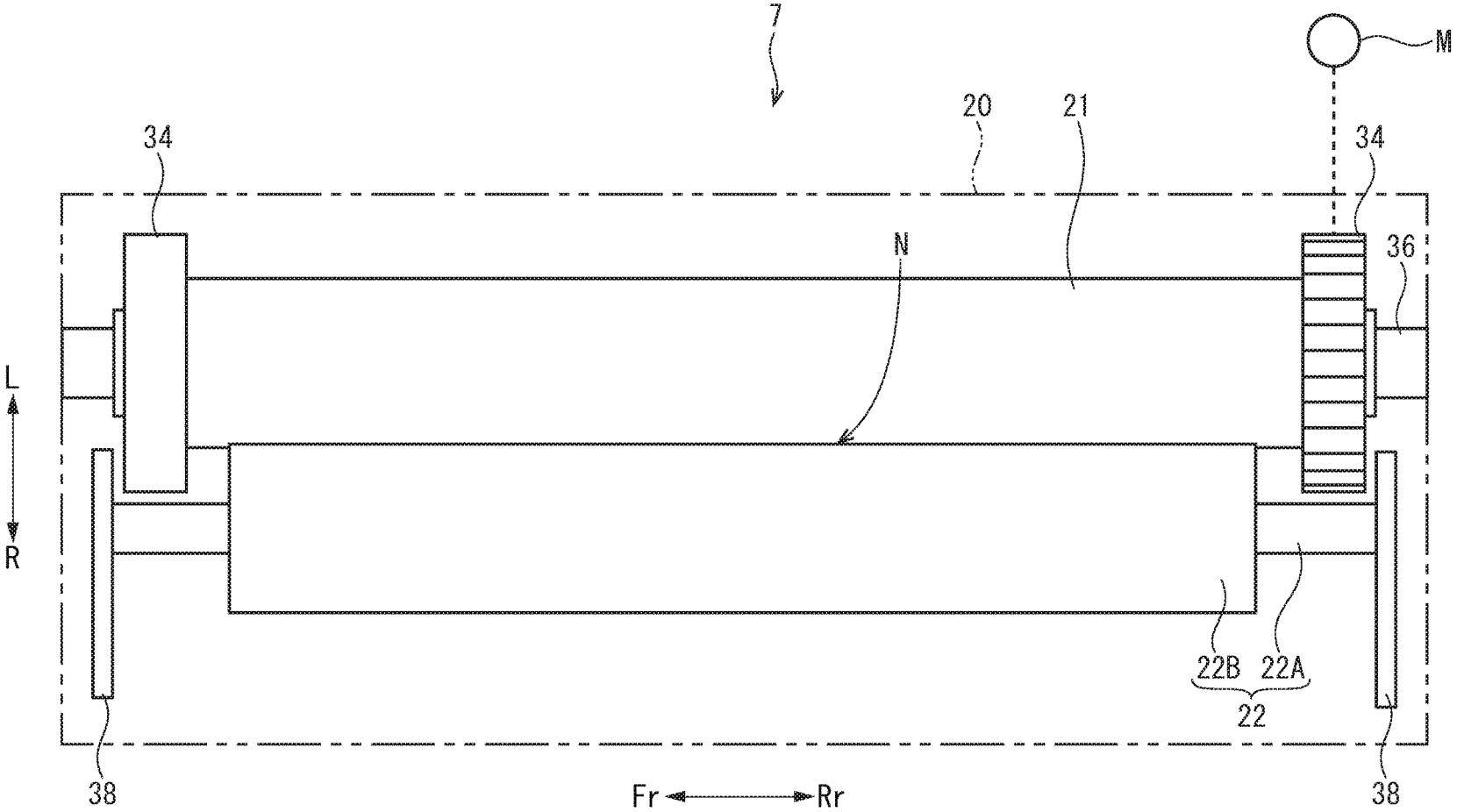
FIG. 3 is a plan view schematically showing an inside of the fixing device according to the first embodiment of the present disclosure.
Figure 4:
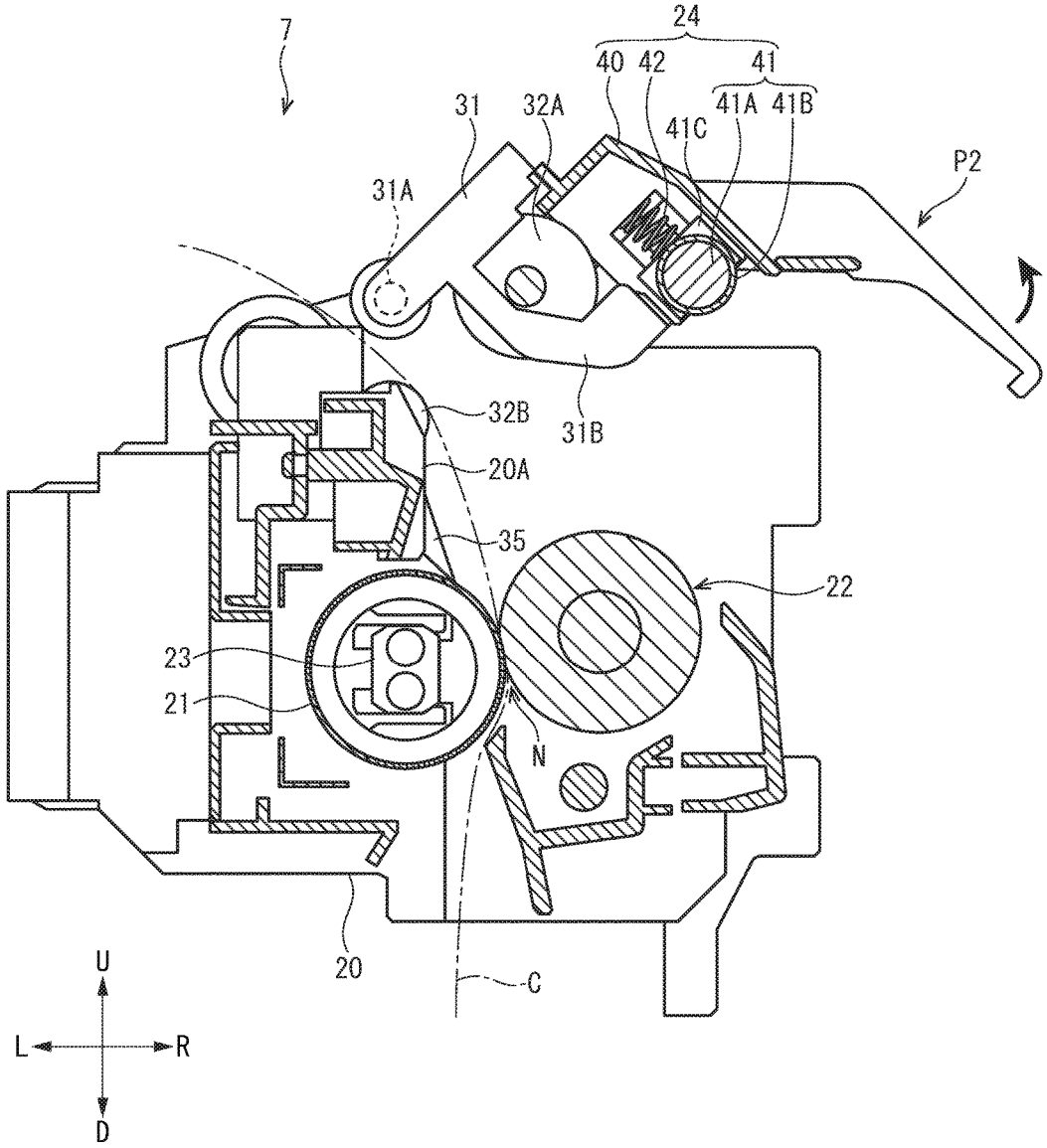
FIG. 4 is a sectional view showing the fixing device in which a cover is opened, according to the first embodiment of the present disclosure.

[The fixing device] Next, with reference to FIG. 2 to FIG. 4, the fixing device 7 will be described. FIG. 2 is a sectional view showing the fixing device 7. FIG. 3 is a plan view schematically showing an inside of the fixing device 7. FIG. 4 is a sectional view showing the fixing device 7 in which a cover 31 is opened. In the specification, "an upstream", "a downstream" and their similar terms respectively indicate "an upstream", "a downstream" and their similar concept in a conveying direction of the sheet S.

The fixing device 7 employs a belt fixing type using a fixing belt 21 having a small heat capacity because the temperature is raised to a preset temperature in a short time. As shown in FIG. 2 and FIG. 3, the fixing device 7 includes a casing 20, a fixing belt 21, a pressing roller 22, a halogen heater 23 and a cleaning device 24. The casing 20 is supported by the apparatus main body 2. The fixing belt 21, the pressing roller 22 and the cleaning device 24 are provided inside the casing 20. The halogen heater 23 is provided in a hollow space of the fixing belt 21.

<The casing> The casing 20 is formed in an approximately rectangular parallelepiped shape elongated in the front-and-rear direction. Inside the casing 20, a part of the conveying path C along which the sheet S is passed is formed. On a lower face and an upper face of the casing 20, openings communicated with the conveying path C in the casing 20 are formed. Near the opening of the lower face of the casing 20, an introducing guide 30 is provided so as to introduce the sheet S to a contact area (a pressing area N) between the fixing belt 21 and the pressing roller 22 (refer to FIG. 2).

(The cover) As shown in FIG. 2, at a right upper portion of the casing 20, a cover 31 is provided which is opened and closed when the sheet S jammed inside the casing 20 is removed (a jam treatment). The cover 31 is made of synthetic resin, for example, and is formed in an approximately plate-like shape elongated in the front-and-rear direction. The cover 31 is formed in an approximately L-shape when viewed from the front side. The cover 31 extends rightward from an opening and closing shaft 31A provided at the upper end and then downward. The cover 31 forms one face of the conveying path C at the downstream side from the pressing area N.

At both front and rear end portions of a left upper end portion of the cover 31, the opening and closing shafts 31A are formed. The opening and closing shafts 31A are supported by side walls of the casing 20 in a rotatable manner. The cover 31 is turned in the upper-and-lower direction (an opening and closing direction) around the opening and closing shafts 31A. The cover 31 is turned in the lower direction (moved in one direction in the opening and closing direction) to form the part of the conveying path C (refer to FIG. 2) while the cover 31 is turned in the upper direction (moved in the other direction in the opening and closing direction) to open the part of the conveying path C (refer to FIG. 4). In the following description, a position of the cover 31 which forms the part of the conveying path C is called as "a closing position P1", and another position of the cover 31 which opens the part of the conveying path C is called as "an opening position P2". The following description is based on a state where the cover 31 is turned to the closing position P1.

As shown in FIG. 2, on an upper portion of an inner face of the cover 31, a cover conveying face part 31B is formed. The cover conveying face part 31B faces a main body conveying face part 20A fixed to the inside of the casing 20 via the conveying path C. The cover conveying face part 31B has a face inclined leftward from the lower portion to the upper portion. On the cover conveying face part 31B, a first discharge roller 32A is supported in a rotatable manner. The first discharge roller 32A is provided at the downstream side of the conveying path C along which the sheet S passed through the pressing area N is passed. On the main body conveying face part 20A, a first facing roller 32B is provided which comes into contact with the first discharge roller 32A when the cover 31 is turned to the closing position P1. The first discharge roller 32A and the first facing roller 32B hold the sheet S passed through the pressing area N and convey the sheet S to the downstream side while rotating around axes. On an upper face of the casing 20, a second discharge roller 33 is provided which feeds the sheet S passed through the discharge roller 32A and the others to the downstream side.

On the main body conveying face part 20A, a separation claw 35 is provided which separates the sheet S, passed through the pressing area N, from the surface of the fixing belt 21. The separation claw 35 extends from the main body conveying face part 20A toward the pressing area N and a tip end portion of the separation claw 35 is brought into contact with the surface of the fixing belt 21.

<The fixing belt> As shown in FIG. 2 and FIG. 3, the fixing belt 21 as an example of a fixing member is an endless belt, and is formed in an approximately cylindrical shape elongated in the front-and-rear direction. The fixing belt 21 is made of heat-resistant and elastic synthetic resin, for example. As shown in FIG. 3, caps 34 are attached to both front and rear end portions of the fixing belt 21 to keep the fixing belt 21 the approximately cylindrical shape. Around an outer circumferential face of the rear cap 34, teeth with which a gear (not shown) is meshed are formed. The rear cap 34 is connected to a drive motor M via a gear train. The drive motor M is connected to the first facing roller 32B via a gear train.

As shown in FIG. 2, in the hollow space of the fixing belt 21, a pressing supporting member 36 and a pressing pad 37 are provided. The pressing supporting member 36 is made of metal, for example, and is formed in an approximately rectangular cylindrical shape elongated in the front-and-rear direction. Both front and rear end portions of the pressing supporting member 36 are penetrated through the caps 34 and fixed to the side walls of the casing 20 (refer to FIG. 3). The fixing belt 21 is supported by the pressing supporting member 36 via the caps 34 so as to be rotated around an axis. The pressing pad 37 is made of heat-resistant synthetic resin, for example, and is formed in an approximately rectangular parallelepiped shape elongated in the front-and-rear direction. The pressing pad 37 is fixed to a right face of the pressing supporting member 36 and receives the fixing belt 21 pressed by the pressing roller 22.

<The pressing roller> As shown in FIG. 2 and FIG. 3, the pressing roller 22 as an example of a pressing member is formed in an approximately cylindrical shape elongated in the front-and-rear direction. The pressing roller 22 includes a core metal 22A made of metal and an elastic layer 22B, made of silicon sponge for example, formed around an outer circumferential face of the core metal 22A.

As shown in FIG. 3, both front and rear end portions of the pressing roller 22 (the core metal 22A) are supported by movable frames 33 (frames) in a rotatable manner. Each movable frame 38 is supported by the casing 20 in a turnable manner in the left-and-right direction. Each movable frame 38 is connected to a pressure change mechanism (not shown) including a spring, an eccentric cam and the others. When the pressure change mechanism turns each movable frame 38 close to the fixing belt 21, the pressing roller 22 is pressed on the fixing belt 21 to form the pressing area N between the pressing roller 22 and the fixing belt 21. On the other hand, when the pressure change mechanism turns each movable frame 38 in a direction apart from the fixing belt 21, the pressing of the pressing roller 22 on the fixing belt 21 is released. The pressing area N shows an area from an upstream position where a pressure is 0 Pa to a downstream position where a pressure is 0 Pa again through a position where a pressure is a maximum value.

<The halogen heater> As shown in FIG. 2, the halogen heater 23 is formed in an approximately rod-like shape elongated in the front-and-rear direction, and is supported by the pressing supporting member 36 in the hollow space of the fixing belt 21. The halogen heater 23 includes a halogen lamp radiating infrared light to heat the fixing belt 21. In the present embodiment, the halogen heater 23 is employed as a heat source; however, a carbon heater may be employed in place of the halogen heater.

<The cleaning device> As shown in FIG. 2, the cleaning device 24 is provided inside the cover 31 so as to be turned (moved) together with the cover 31. The cleaning device 24 includes a cleaning case 40, a cleaning roller 41 and a pair of coil springs 42. The cleaning case 40 is supported by the cover 31. The cleaning roller 41 and the pair of coil springs 42 are provided inside the cleaning case 40.

The cleaning case 40 is formed in an approximately rectangular parallelepiped shape elongated in the front-and-rear direction. In detail, the cleaning case 40 is formed in a box-like shape having an approximately L-shaped cross section. A lower face and a left side face of the cleaning case 40 are opened. The cleaning case 40 is arranged above the pressing roller 22 and at the right side of the first discharge roller 32A. The cleaning case 40 is fixed to the cover 31 with the lower opened face facing the pressing roller 22.

The cleaning roller 41 as an example of a cleaning member is formed in an approximately cylindrical shape elongated in the front-end-rear direction. The cleaning roller 41 includes a core metal 41A made of metal and a wipe member 41B, made of fabric or non-woven fabric, fixed (wound) around an outer circumferential face of the core metal 41A. Both front and rear end portions of the cleaning roller 41 (the core metal 41A) are supported by bearings 41C supported by front and rear end portions of the cleaning case 40. The cleaning roller 41 is supported by the cleaning case 40 via the bearings 41C in a rotatable manner around an axis. When the cover 31 is turned to the closing position P1, a lower portion of the cleaning roller 41 is exposed through the opened lower face of the cleaning case 40 and comes into contact with an upper surface of the pressing roller 22 with a predetermined pressure.

The coil springs 42 are arranged at the both front and rear end portions of the cleaning case 40. An upper end portion of each coil spring 42 is connected to the cleaning case 40 and a lower end portion of each coil spring 42 is connected to the bearing 41C. The coil springs 42 are interposed between the cleaning case 40 and the bearings 41C to bias the cleaning roller 41 downward via the bearings 41C. As a result, the cleaning roller 41 is pressed against the surface of the pressing roller 22.

Inside the casing 20, a temperature sensor (not shown), such as a thermopile or a thermistor, detecting a temperature of the surface of the fixing belt 21 is provided. To a control device of the color printer 1, the drive motor M, the halogen heater 23 and the temperature sensor are electrically connected. The control device controls the drive motor M, the halogen hater 23 and the temperature sensor via various drive circuits.

[An operation of the fixing device] With reference to FIG. 2 mainly, an operation of the fixing device 7 (a fixing processing) will be described. When the fixing processing (the image forming processing) is performed, the cover 31 is turned to the closing position P1. The pressing roller 22 is pressed against the fixing belt 21 by the pressure change mechanism.

First, the control device controls the drive motor M and the halogen heater 23 to drive them. The fixing belt 21 and the first facing roller 32B are driven by the drive force of the drive motor M to be rotated in the counterclockwise direction in FIG. 2. The pressing roller 22 is driven by the fixing belt 21 to be rotated in the clockwise direction in FIG. 2. The cleaning roller 41 is driven by the pressing roller 22 to be rotated in the counterclockwise direction in FIG. 2. The halogen heater 23 heats the fixing belt 21 from the inside of the fixing belt 21. The temperature sensor outputs a detection signal showing a temperature of the fixing belt 21 (or the halogen heater 23) to the control device via an input circuit. When received the detection signal showing that the detected temperature reaches a preset temperature, from the temperature sensor, the control device begins to perform the above described image forming processing.

The sheet S on which the toner image is transferred enters the inside of the casing 20, and the fixing belt 21 heats the toner (the toner image) on the sheet S passing through the pressing area N while rotating around the axis. The pressing roller 22 presses the toner on the sheet S passing through the pressing area N while rotating around the axis. As a result, the toner image is fixed to the sheet S. The separation claw 35 separates the sheet S passed through the pressing area N from the surface of the fixing belt 21. Then, the sheet S on which the toner image is fixed is passed through between the first discharge roller 32A and the first facing roller 32B to the outside of the casing 20 and then ejected on the ejected sheet tray 4 finally.

By the way, because the separation claw 35 comes into contact with the surface of the sheet S on which the toner image is fixed, foreign substance, such as the toner and dust, may stay near the separation claw 35. The stayed foreign substance may be adhered to the surface of the pressing roller 22. Then, the foreign substance adhered to the surface of the pressing roller 22 may be adhered to the back face of the next fed sheet S or transfer to the fixing belt 21 again.

Then, according to the fixing device 7, the cleaning device 24 is configured to bring the cleaning roller 41 into contact with the surface of the pressing roller 22 and to clean the surface of the pressing roller 22. The cleaning roller 41 wipes the surface of the pressing roller 22 while rotating in a direction (refer to an arrow in FIG. 2) following the rotation of the pressing roller 22. As a result, the foreign substance, such as the toner, adhered to the surface of the pressing roller 22 is removed.

[A jam treatment] Next, with reference to FIG. 4, the jam treatment in the fixing device 7 will be described.

The color printer 1 detects a conveying failure (a jam) of the sheet S using a detection device (not shown) suitably arranged on the conveying path C. When the jam is occurred, the control device stops the image forming operation and displays a massage showing the occurrence of the jam on a liquid crystal panel or the like (not shown). For example, when the jam is occurred inside the casing 20 (the press area N) of the fixing device 7, a user opens an opening and closing door (not shown) provided on a side face of the apparatus main body 2 and then performs the jam treatment as described later.

First, the user turns the cover 31 upward around the opening and closing shaft 31A. When the cover 31 is turned from the closing position P1 to the opening position P2, the conveying path C inside the casing 20 is exposed. In this state, because the main body conveying face part 20A, the pressing roller 22 and the others are exposed, the user can remove the sheet S jammed in the conveying path C (the press area N) inside the casing 20 easily. As the cover 31 is turned from the closing position P1 to the opening position P2, the pressure change mechanism may preferably release the pressing of the pressing roller 22 on the fixing belt 21.

After the sheet S is removed, the user turns the cover 31 downward from the opening position P2 to the closing position P1 and the jam treatment is finished. This makes it possible to perform the image forming processing (the fixing processing) again.

[Maintenance work of the cleaning device] Next, with reference to FIG. 4, a maintenance work of the cleaning device 24 of the fixing device 7 will be described.

When the cleaning of the pressing roller 22 by the cleaning device 24 (the cleaning roller 41) is repeatedly performed, the wipe member 41B of the cleaning roller 41 may be clogged with the foreign substance such as the toner or the wipe member 41B may be worn. Therefore, it is required to perform the maintenance and the management of the cleaning device 24 (the cleaning roller 41) periodically. For example, the foreign substance clogged in the wipe member 41B may be cleaned (removed) or the worn cleaning roller 41 may be replaced with new one.

When the maintenance work of the cleaning device 24 is performed, the user turns the cover 31 upward from the closing position P1 to the opening position P2 in the same manner as the above jam treatment. Then, the cleaning device 24 is brought up together with the cover 31 and arranged outside the casing 20. As a result, because a large work space is formed between the cleaning device 24 (the cleaning roller 41) and the pressing roller 22, the user can easily perform the maintenance work of the cleaning device 24, such as the cleaning or the replacement of the cleaning roller 41.

The fixing device 7 according to the first embodiment as described above has a configuration that the cleaning device 24 (the cleaning roller 41) is turned (moved) together with the cover 31. According to the configuration, when the cover 31 is opened, it becomes possible to displace the cleaning device 24 including the cleaning roller 41 to the outside of the fixing device 7 and to perform the maintenance work, such as the cleaning work and the replacement work of the contaminated cleaning roller 41, at the outside of the fixing device 7. Thereby, it becomes possible to perform the maintenance and the management of the cleaning roller 41 easily (improvement in workability).

According to the fixing device 7 according to the first embodiment, because the cleaning roller 41 is driven by the pressing roller 22 to be rotated, it becomes possible to remove the foreign substance, such as the toner, adhered to the surface of the press roller 22 effectively without damaging the surface of the pressing roller 22.

Figure 5:
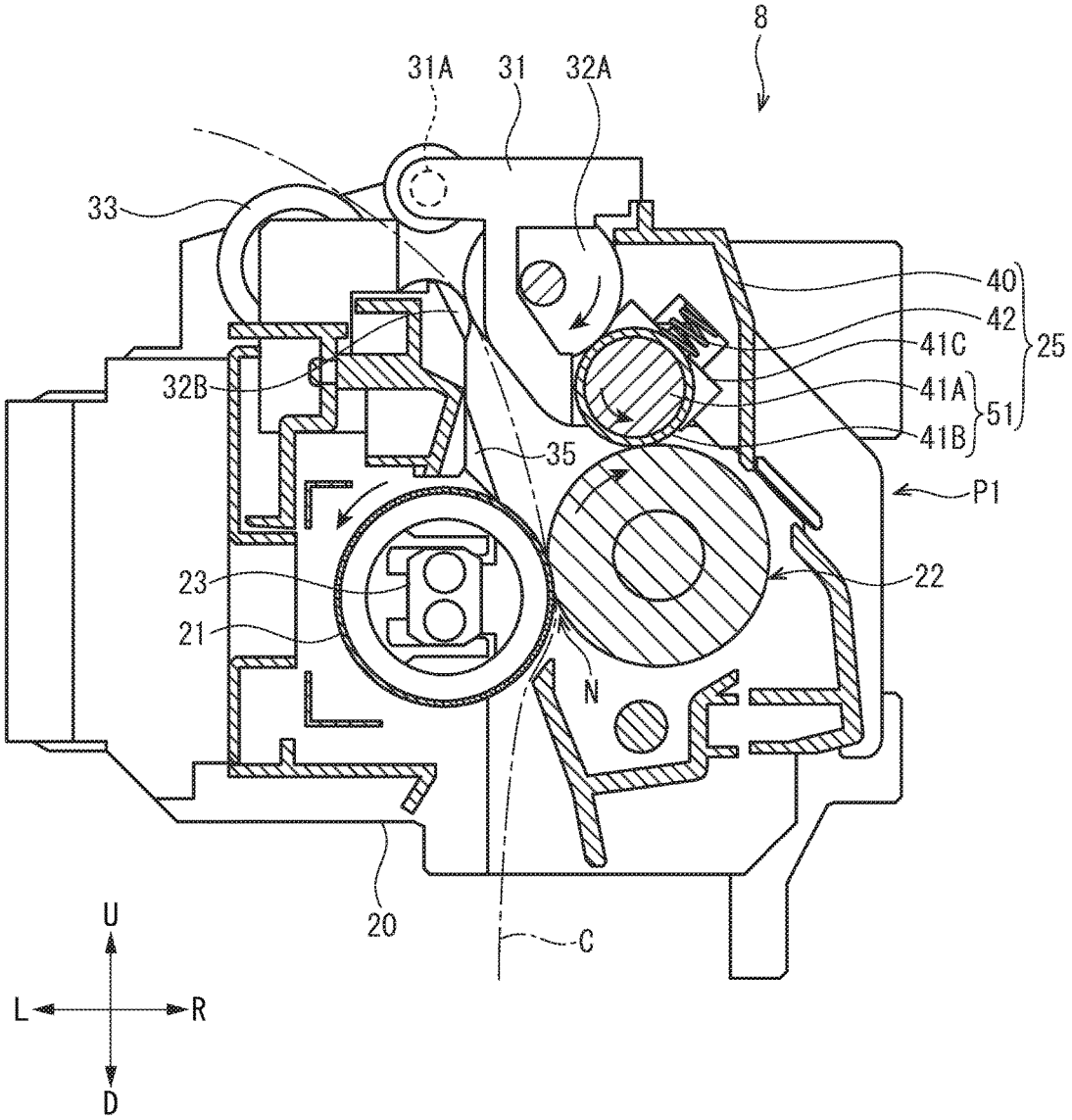
FIG. 5 is a sectional view showing the fixing device according to a second embodiment of the present disclosure.
Figure 6:
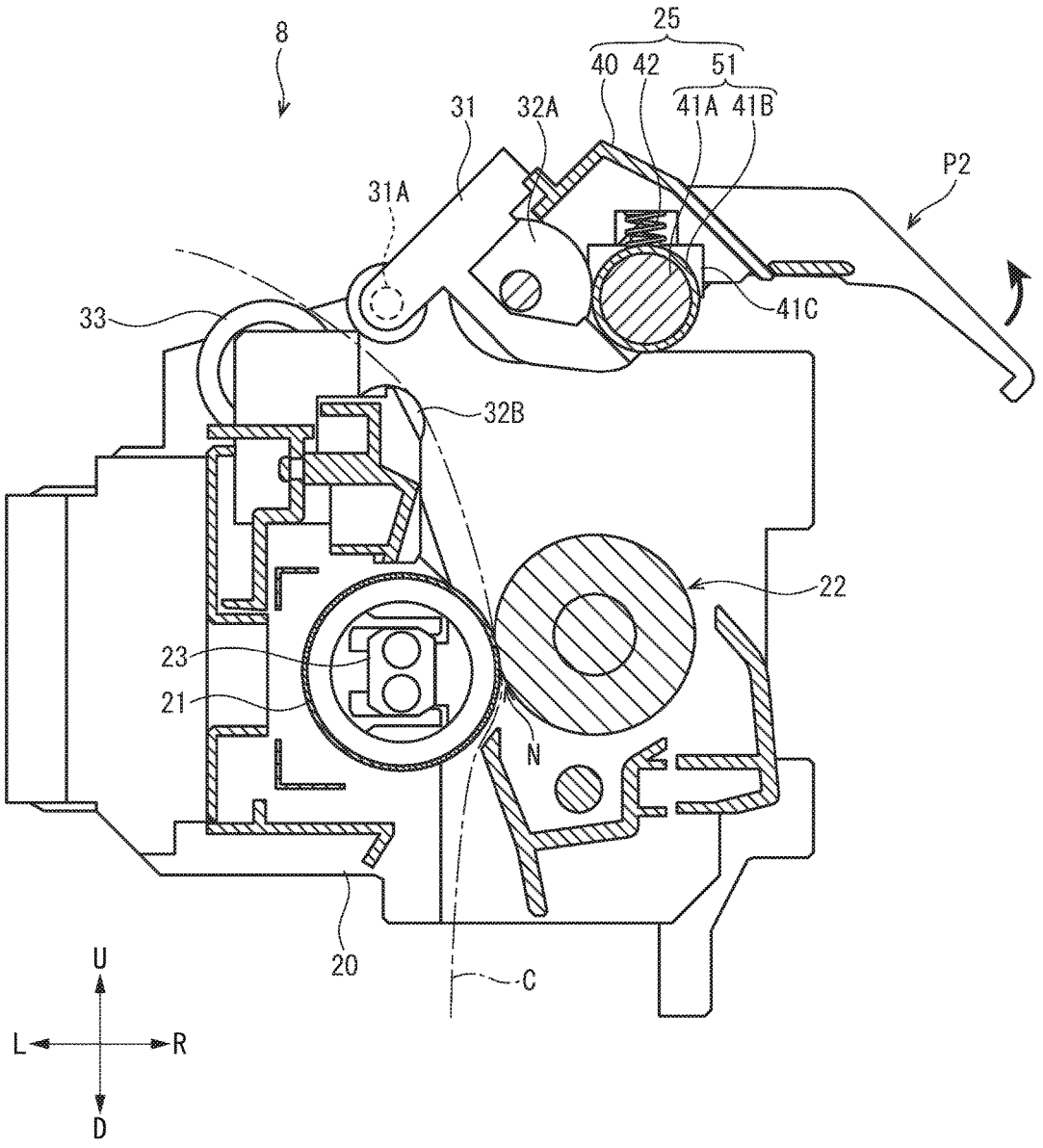
FIG. 6 is a sectional view showing the fixing device in which the cover is opened, according to the second embodiment of the present disclosure.

[A second embodiment] Next, with reference to FIG. 5 and FIG. 6, the fixing device 8 according to the second embodiment will be described. FIG. 5 is a sectional view showing the fixing device 8. FIG. 6 is a sectional view showing the fixing device 8 in which the cover 31 is opened. In the following description, the configuration similar to or corresponding to the configuration of the fixing device 7 of the first embodiment are marked with the same reference numbers as the first embodiment, and its similar or corresponding description is omitted.

By the way, the foreign substance, such as the toner, stayed near the separation claw 35 may be carried by the sheet S and adhered to the surface of the first discharge roller 32A. Then, the foreign substance adhered to the surface of the pressing roller 22 may be adhered to the back face of the next fed sheet S.

Then, as shown in FIG. 5, the fixing device 8 according to the second embodiment has a configuration that the cleaning roller 51 of the cleaning device 25 cleans the surface of the pressing roller 22 and the surface of the first discharge roller 32A while rotating. Specifically, the cleaning roller 51 is provided between the pressing roller 32 and the first discharge roller 32A, and comes into contact with the surface of the pressing roller 22 and the surface of the first discharge roller 32A in the state where the cover 31 is turned to the closing position P1 (moved in one direction in the opening and closing direction).

The coil springs 42 bias the cleaning roller 51 in a left oblique direction via the bearings 41C. Then, the cleaning roller 51 is pressed on both the pressing roller 22 and the first discharge roller 32A. In detail, a contact pressure of the cleaning roller 51 to the surface of the pressing roller 22 is set to be larger than a contact pressure of the cleaning roller 51 to the first discharge roller 32A. That is, each coil spring 42 is arranged at an angle such that the cleaning roller 51 is pressed on the pressing roller 22 with a larger force than a force with which the cleaning roller 51 is pressed on the first discharge roller 32A.

The cleaning roller 51 wipes the surfaces of the pressing roller 22 and the first discharge roller 32A while rotating in a direction following the rotation of the pressing roller 22 and the first discharge roller 32A. As a result, the foreign substance, such as the toner, adhered to the surfaces of the pressing roller 22 and the first discharge roller 32A is removed.

In the cleaning device 25 of the fixing device 8, the maintenance work is performed in the same manner as the cleaning device 24 of the first embodiment. That is, as shown in FIG. 6, the user opens the cover 31 to arrange the cleaning device 25 outside the casing 20. Then, the user performs the cleaning or the replacement (the maintenance work) of the cleaning roller 41 using a large work space formed under the cleaning roller 51.

The fixing device 8 according to the second embodiment as described above is configured such that the cleaning roller 51 to clean the surface of the pressing roller 22 also has a function to clean the surface of the first discharge roller 32A.

According to the configuration, because the surfaces of the pressing roller 22 and the first discharge roller 32A are kept clean, it becomes possible to form a fine image with less image noise. Additionally, according to the configuration, because a dedicated member for cleaning the first discharge roller 32A only is not provided separately, it becomes possible to decrease a manufacturing cost of the fixing device 8.

The fixing device 8 according to the second embodiment is configured such that the cleaning roller 51 is pressed on the pressing roller 22 with a larger force than on the first discharge roller 32A. According to the configuration, the pressing roller 22 is cleaned preferentially so that it becomes possible to decrease a possibility where the foreign substance is adhered to the sheet S passed through the press area N. Therefore, it becomes possible to decrease a possibility that the foreign substance is carried to the first discharge roller 32A from the press roller 22 via the sheet S. As a result, it becomes possible to form an image with less image noise.

Figure 7:
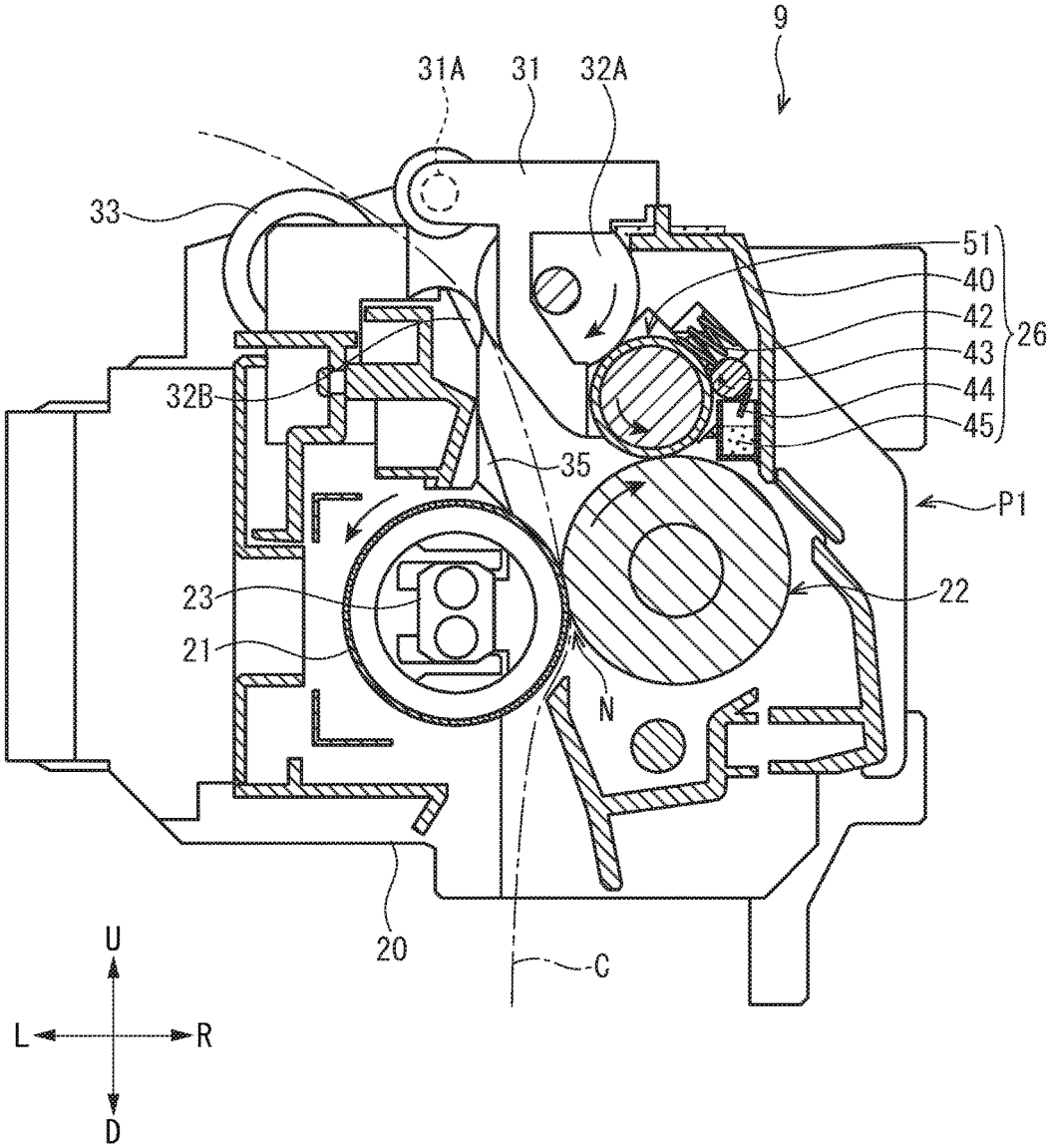
FIG. 7 is a sectional view showing the fixing device according to a third embodiment of the present disclosure.
Figure 8:
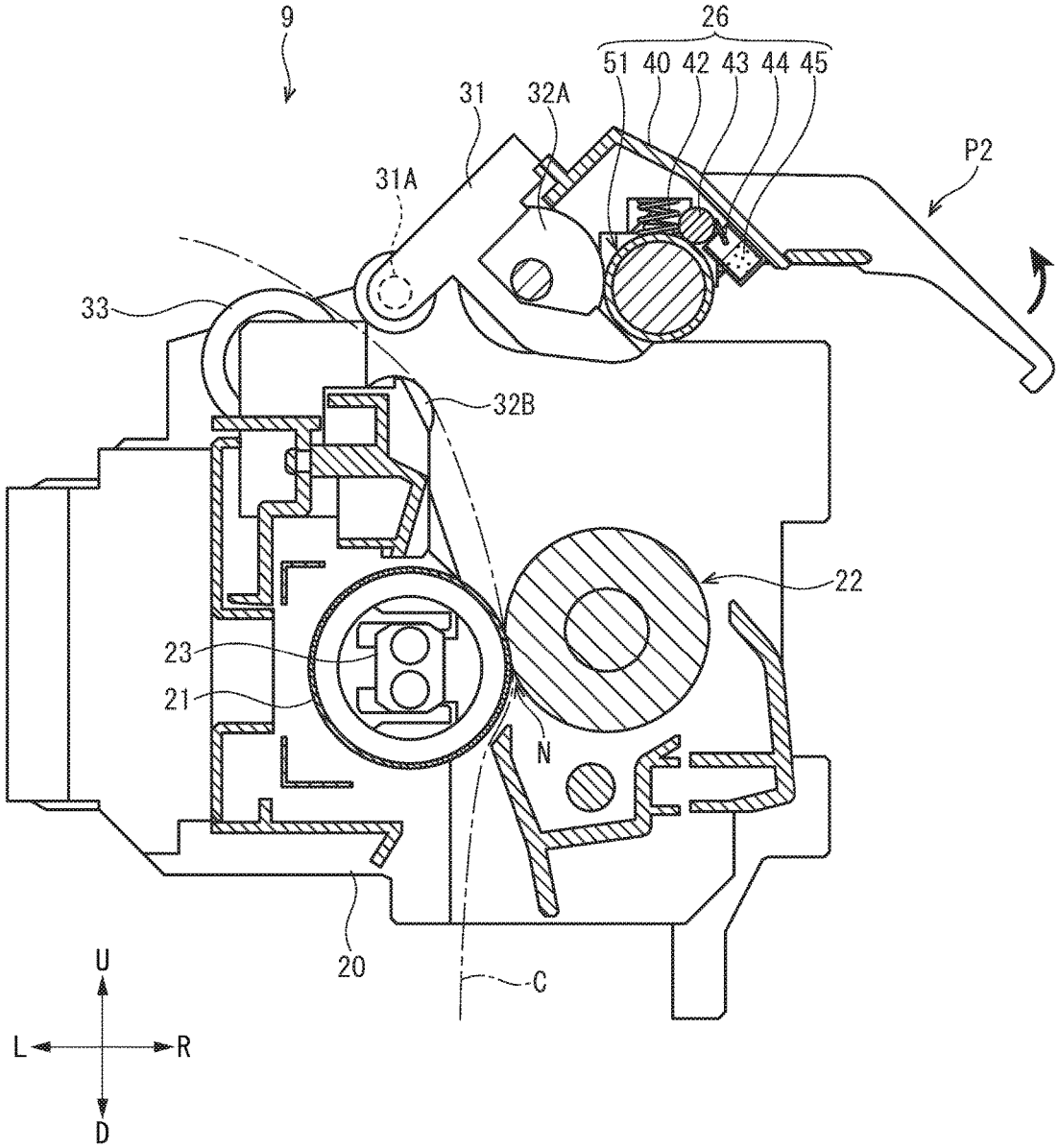
FIG. 8 is a sectional view showing the fixing device in which the cover is opened, according to the third embodiment of the present disclosure.

[A third embodiment] Next, with reference to FIG. 7 and FIG. 8, the fixing device 9 according to the third embodiment will be described. FIG. 7 is a sectional view showing the fixing device 9. FIG. 8 is a sectional view showing the fixing device 9 in which the cover 31 is opened. In the following description, the configuration similar to or corresponding to the configuration of the fixing device 8 of the second embodiment are marked with the same reference numbers as the second embodiment, and its similar or corresponding description is omitted.

By the way, when the cleaning of the pressing roller 22 and the first discharge roller 32A using the cleaning roller 51 is repeatedly performed, a performance to remove the foreign substance by the cleaning roller 51 is deteriorated due to clogging of the wipe member 41B with the toner or other reason.

Then, as shown in FIG. 7, the fixing device 9 according to the third embodiment has a configuration to keep the performance of the cleaning roller 51 constant. Specifically, the cleaning device 26 includes a removal roller 43, a plate member 44 and a waste case 45 in addition to the cleaning case 40, the cleaning roller 51 and the pair of coil springs 42.

The removal roller 43 as an example of a removal member is made of metal, such as iron, and is formed in an approximately column shape elongated in the front-and-rear direction. The removal roller 43 is supported by the cleaning case 40 in a rotatable manner around an axis. The removal roller 41 comes into contact with a right side surface of the cleaning roller 41 with a predetermined pressure.

The plate member 44 is made of elastic synthetic resin film, for example, and is formed in an approximately plate-like shape elongated in the front-and-rear direction. The plate member 44 is fixed to the cleaning case 40 with an approximately upright posture. A tip end portion of the plate member 44 comes into contact with a right lower face of the removal roller 43 with a predetermined pressure.

The waste container 45 is formed in an approximately rectangular parallelepiped shape elongated in the front-and-rear direction. In detail, the waste container 41 is formed in a box-like shape and has an approximately U-shaped cross section. An upper face of the waste container 41 is opened. The waste container 45 is arranged at the right side of the cleaning roller 51 and below the removal roller 43 and the plate member 44. The waste container 45 is attached to the cleaning case 40 with the opened upper face facing the removal roller 43 and the plate member 44. The waste container 45 is detachably attached to the cleaning case 40.

[An operation of the cleaning device] In the cleaning device 26 of the fixing device 9, the cleaning roller 51 cleans the surface of the pressing roller 22 and the surface of the first discharge roller 32A in the same manner as the cleaning device 25 of the fixing device 9 according to the second embodiment. The removal roller 43 is driven by the cleaning roller 41 to be rotated in the clockwise direction in FIG. 7. The removal roller 43 comes into contact with the surface of the cleaning roller 51 to clean the surface of the cleaning roller 51. The removal roller 43 collects the foreign substance, such as the toner, adhered to the surface of the cleaning roller 51 while being driven by the rotation of the cleaning roller 51 to be rotated. The tip end portion of the plate member 44 comes into contact with the removal roller 43 from a counter direction to the rotation direction of the removal roller 43. The plate member 44 comes into contact with the surface of the removal roller 43 and scrapes the foreign substance, such as the toner, adhered to the surface of the removal roller 43. The scraped foreign substance falls in the waste container 45. The waste container 4 stores the foreign substance scraped by the plate member 44.

[Maintenance work of the cleaning device] In the cleaning device 26 of the fixing device 9, the maintenance work is performed in the same process as the cleaning devices 24 and 25 according to the first and second embodiments. In the maintenance work of the cleaning device 26, it is required to collect the foreign substance stored in the waste container periodically, in addition to the cleaning and the replacement of the cleaning roller 51. That is, as shown in FIG. 8, the user opens the cover 31 to arrange the cleaning device 26 outside the casing 20 and then performs the cleaning and the replacement of the cleaning roller 51. The user detaches the waste container 45 from the cleaning case 40 and deposits the foreign substance, such as the toner, stored in the waste container 45. Then, the user attaches the empty waste container 45 to the cleaning case 40 again and closes the cover 31. Then, the maintenance work is finished.

According to the fixing device 9 according to the third embodiment as described above, because the removal roller 43 cleans the cleaning roller 51, it become possible to keep the performance (the foreign substance removal performance) of the cleaning roller 51 constant for a long period. Thereby, it becomes possible to reduce a number of the maintenance work and a cost for the maintenance work and the management of the fixing device 9.

Additionally, according to the fixing device 9 according to the third embodiment, because the plate member 44 scrapes the foreign substance from the removal roller 43, it becomes possible to keep the performance (the foreign substance collection performance) of the removal roller 43 constant for a long period. Thereby, it becomes possible to reduce a number of the maintenance work of the removal roller 43. Additionally, it becomes possible to gather the foreign substance, such as the toner, scraped from the removal roller 43 in the waste container 45. Thereby, opening the cover 31 makes it possible to collect the foreign substance gathered in the waste container 45 easily. Additionally, it becomes possible to restrict the inside of the fixing device 9 (the casing 20) from being contaminated with the foreign substance.

The above described removal roller 43, the plate member 44 and the waste container 45 may be applied to the cleaning device 24 of the fixing device 7 according to the first embodiment (not shown).

The fixing devices 7 to 9 according to the first to the third embodiments are configured such that the drive motor M drives the fixing belt 21 and the first facing roller 32A to be rotated. The present disclosure is not limited to the configuration. The drive motor M may drive the pressing roller 22 to be rotated, or the drive motor M may drive the discharge roller 32A to be rotated. Additionally, the fixing devices 7 to 9 are configured such that the pressing roller 22 is pressed on the fixing belt 21 to form the pressing area N; however, the present disclosure is not limited to the configuration. The fixing belt 21 may be pressed on the pressing roller 22 to form the pressing area N.

The fixing devices 7 to 9 according to the first to the third embodiments employs the fixing belt 21 rotating around one axis, as an example of the fixing member. The present disclosure is not limited thereto. As another example of the fixing member, a fixing belt (not shown) wound around plural rollers may be employed. As still another example of the fixing member, a fixing roller in which an elastic layer is formed on an outer circumferential face of a core metal may be employed.

In the fixing device 7 according to the first embodiment, the cleaning roller 41 comes into contact with the pressing roller 22. In the fixing devices 8 and 9 according to the second and the third embodiments, the cleaning roller 51 comes into contact with the pressing roller 22 and the first discharge roller 32A. The present disclosure is not limited thereto. For example, the cleaning roller 41 may come into contact with the surface of the fixing belt 21 and clean the surface of the first facing roller 32B. The cleaning roller 41 may come into contact with the surface of the fixing belt 21 and the surface of the first facing roller 32B and clean the surfaces. In these cases, the cleaning rollers 41 and 51 are driven by the rotation of the fixing belt 21 to be rotated.

In the fixing devices 7 to 9 according to the first to the third embodiments, the cleaning rollers 41 and 51 are driven by the rotation of the pressing roller 22 to be rotated. In the fixing device 9 according to the third embodiment, the removal roller 43 is driven by the rotation of the cleaning roller 51 to be rotated. The present disclosure is not limited thereto. For example, the cleaning roller 41 and 51 and the removal roller 43 may be driven by a motor (not shown) to be rotated. In this case, the cleaning rollers 41 ad 51 are preferably rotated in a direction following the rotation of the pressing roller 22, and the removal roller 43 is preferably rotated in a direction following the rotation of the cleaning roller 51.

In the fixing devices 7 to 9 according to the first to the third embodiments, the cleaning rollers 41 and 51 around which the wipe members 41B are wound are employed as an example of the cleaning member. The present disclosure is not limited thereto. As another example of the cleaning member, for example, a brush roller (not shown) in which fibers (bristles) are planted on an outer circumferential face of a core metal 41A may be employed. Alternatively, as still another example of the cleaning member, for example, a brush (not shown) in which fibers (bristles) are planted on a plate may be fixed to the cover 31 in a non-rotatable manner. In the fixing device 9 according to the third embodiment, the removal roller 43 is employed as the removal member. The present disclosure is not limited thereto. The removal member may be a brush roller or a brush in which fibers are planted on a plate.

In the fixing devices 8 and 9 according to the second and the third embodiments, the cleaning roller 51 is biased to the pressing roller 22 and the first discharge roller 32A by the coil spring 42 biasing them in one direction. The present disclosure is not limited thereto. For example, a spring which biases the cleaning roller 51 toward the pressing roller 22 and another spring which bases the cleaning roller 51 toward the first discharge roller 32A may be provided independently (they are not shown). Alternatively, the cleaning roller 51 may be pressed to the pressing roller 22 and the first discharge roller 32A without using the coil spring, in the state where the cover 31 is turned to the cleaning position P1.

In the description of the first to the third embodiments, the present disclosure is applied to the color printer 1; however, the present disclosure is not limited thereto. The present disclosure may be applied to a monochrome printer, a copying machine, a facsimile machine and a multifunctional peripheral.

While the above description has been described with reference to the particular illustrative embodiments of the image forming apparatus according to the present disclosure, a technical range of the disclosure is not to be restricted by the description and illustration of the embodiment.

The invention claimed is:

1. A fixing device comprising:

a fixing member configured to heat a toner on a medium while rotating;

a pressing member configured to form a pressing area with the fixing member while rotating and to press the toner on the medium passing through the pressing area;

a cover configured to be moved in one direction in an opening and closing direction to form a part of a conveying path for the medium and to be moved in the other direction in the opening and closing direction to open the part of the conveying path; and a cleaning device provided in the cover and configured to bring a cleaning member into contact with a surface of the pressing member in a state where the cover is moved in the one direction and to clean the surface of the pressing member.

2. The fixing device according to claim 1, wherein the cleaning member is driven by a rotation of the pressing member to be rotated.

3. The fixing member according to claim 2, further comprising a discharge roller provided at a downstream side of the pressing area on the conveying path and configured to convey the medium to the downstream side while rotating, wherein the cleaning member cleans the surface of the pressing member and a surface of the discharge roller while coming into contact with the surface of the pressing member and the surface of the discharge roller and rotating in the state where the cover is moved to the one direction.

4. The fixing device according to claim 3, wherein the cover is supported in a turnable manner around an opening and closing shaft, and the discharge roller is supported by the cover in a rotatable manner.

5. The fixing device according to claim 3, wherein a contact pressure between the pressing member and the cleaning member is set to be larger than a contact pressure between the cleaning roller and the discharge roller.

6. The fixing device according to claim 2, wherein the cleaning device includes a removal member configured to come into contact with the surface of the cleaning member and to clean a surface of the cleaning member.

7. The fixing device according to claim 6, wherein the removal member is driven by a rotation of the cleaning member to be rotated, and the cleaning device includes:

a plate member configured to come into contact with a surface of the removal member and to scrape foreign substance adhered to the surface of the removal member; and a waste container configured to collect the foreign substance scraped by the plate member.

8. The fixing device according to claim 1, wherein the cleaning device includes a biasing member configured to bias the cleaning member so as to come into contact with the pressing member in the state where the cover is moved in the one direction.

9. The fixing device according to claim 1, comprising a casing in which the fixing member and the pressing member are stored, wherein the cleaning device is arranged outside the casing in a state where the cover is moved to the other direction.

10. An image forming apparatus comprising the fixing device according to claim 1.

* * * * *